US006478605B2

(12) United States Patent
Stuckmann et al.

(10) Patent No.: US 6,478,605 B2
(45) Date of Patent: Nov. 12, 2002

(54) TERMINAL BLOCK WITH DISCONNECT CONTACT AND TERMINAL ARRANGEMENT

(75) Inventors: Peter Stuckmann, Lage (DE); Reinhard Nolting, Detmold (DE); Stephan Fehling, Lage (DE); Torsten Diekmann, Bielefeld (DE)

(73) Assignee: Weidmueller Interface GmbH & Co., Detmold (DE)

( * ) Notice: Subject to any disclaimer, the term of this patent is extended or adjusted under 35 U.S.C. 154(b) by 0 days.

(21) Appl. No.: 09/950,603

(22) Filed: Sep. 13, 2001

(65) Prior Publication Data

US 2002/0037671 A1 Mar. 28, 2002

(30) Foreign Application Priority Data

| | | |
|---|---|---|
| Sep. 25, 2000 | (DE) | 200 16 654 U |
| Jan. 20, 2001 | (DE) | 201 01 035 U |
| Apr. 14, 2001 | (DE) | 201 06 523 U |

(51) Int. Cl.[7] ..... H01R 11/20

(52) U.S. Cl. ..... 439/409; 439/417; 439/395; 439/716; 439/532; 439/406

(58) Field of Search ..... 439/409, 406, 439/417, 395, 716, 709, 532

(56) References Cited

U.S. PATENT DOCUMENTS

| | | | | |
|---|---|---|---|---|
| 4,648,673 A | * | 3/1987 | Endo et al. | 439/395 |
| 5,554,048 A | * | 9/1996 | Martins | 439/395 |
| 6,027,361 A | * | 2/2000 | Burmeister et al. | 439/395 |
| 6,120,315 A | * | 9/2000 | Gaertner et al. | 439/395 |

FOREIGN PATENT DOCUMENTS

| | | |
|---|---|---|
| DE | 196 27 209 C1 | 10/1997 |
| DE | 197 32 182 C1 | 3/1999 |
| EP | 0 936 697 A1 | 11/1998 |

* cited by examiner

*Primary Examiner*—Tho D. Ta
(74) *Attorney, Agent, or Firm*—Lawrence E. Laubscher, Sr.

(57) ABSTRACT

A terminal block assembly includes at each end a generally U-shaped support spring having leg portions that extend upwardly in straddling relation on opposite sides of the stationary resilient contacts at opposite ends of the bus bar, thereby to support the stationary contacts as insulated conductors are displaced by actuator members toward cutting engagement with knife edges on the adjacent ends of the reversely inwardly directed stationary resilient contacts.

24 Claims, 16 Drawing Sheets

Fig. 7a
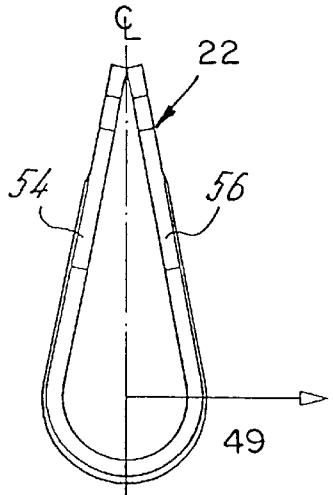
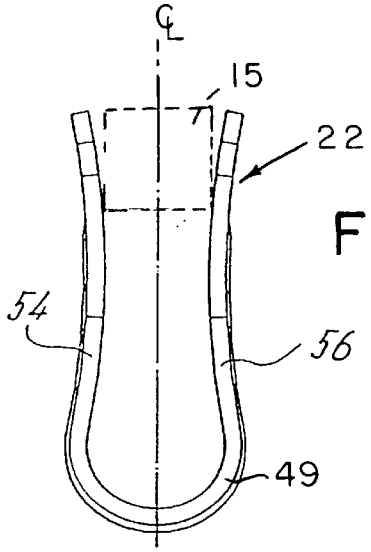
Fig. 7b
Fig. 7c
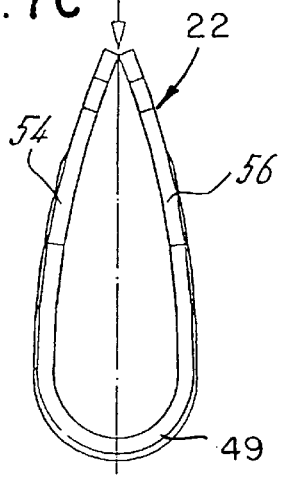
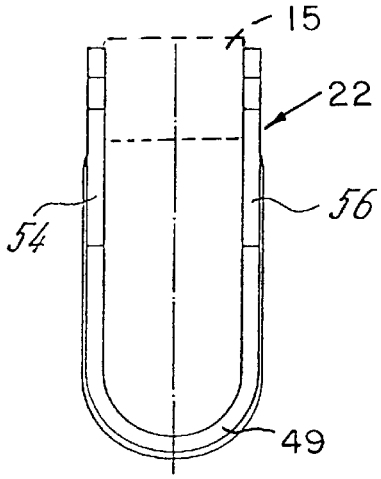
Fig. 7d
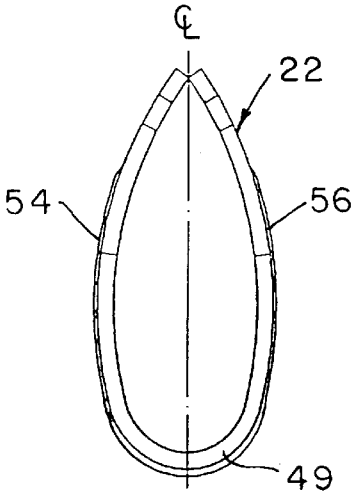
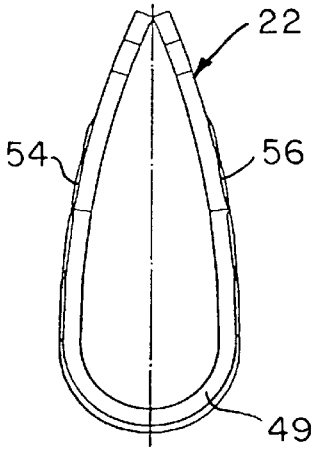
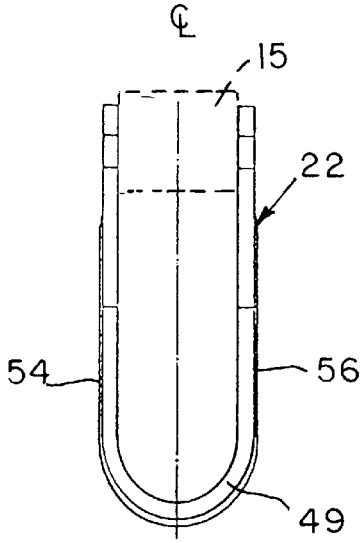
Fig. 7e Fig. 7f Fig. 7g

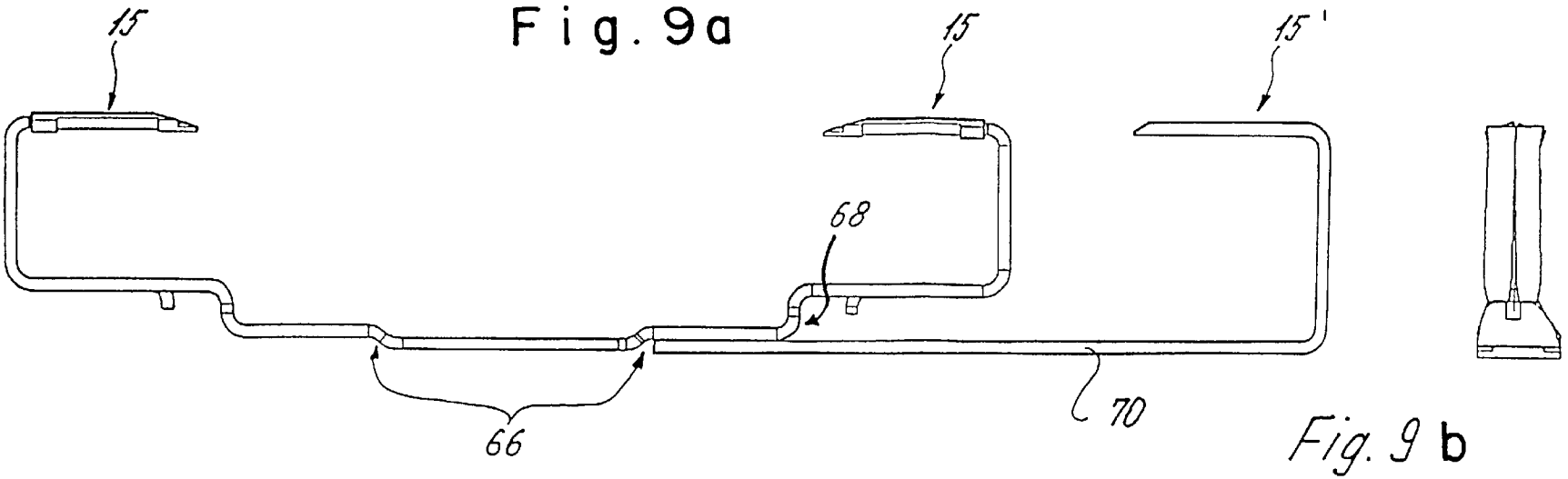
Fig. 9a
Fig. 9b
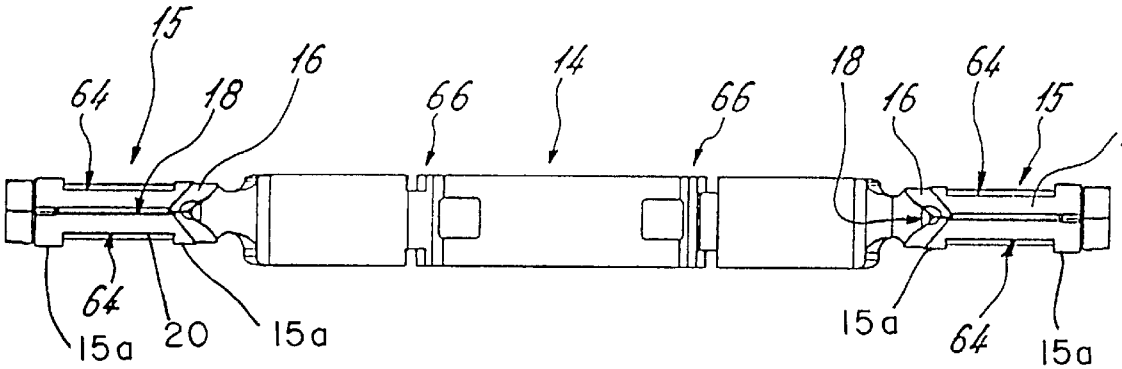
Fig. 10

Fig.11a
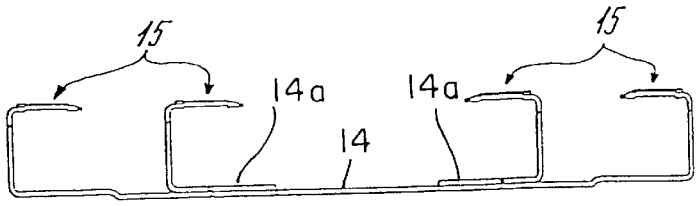
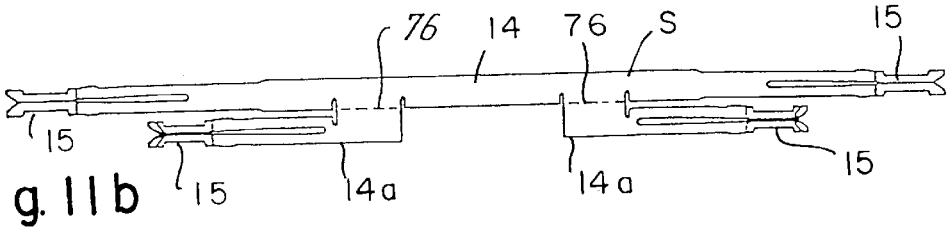
Fig.11b
Fig.11c
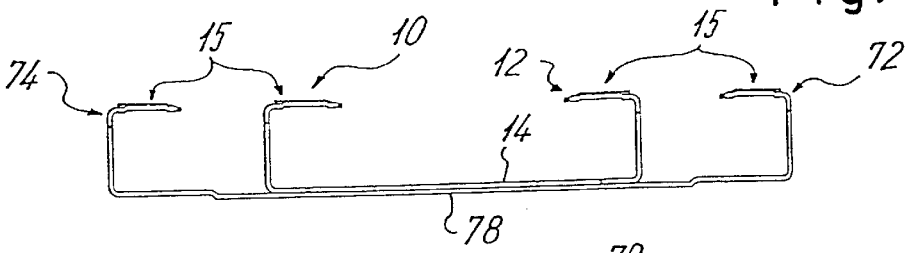
Fig.11d
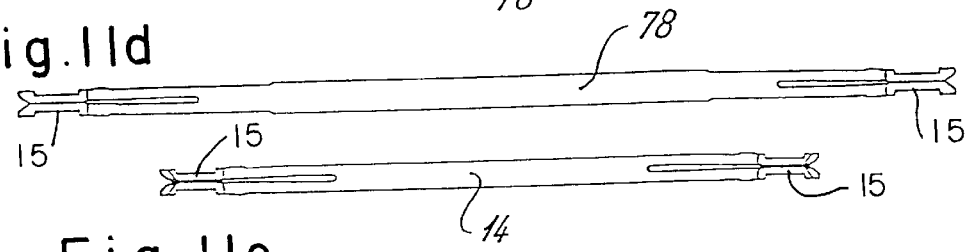
Fig.11e
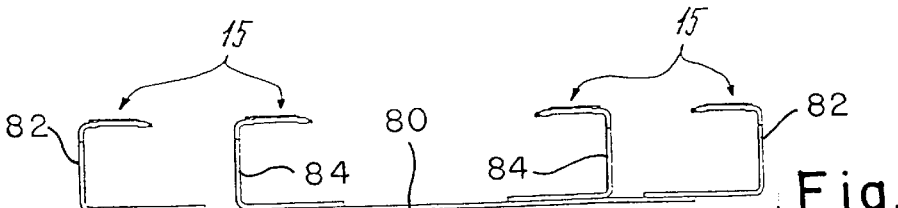
Fig.11f
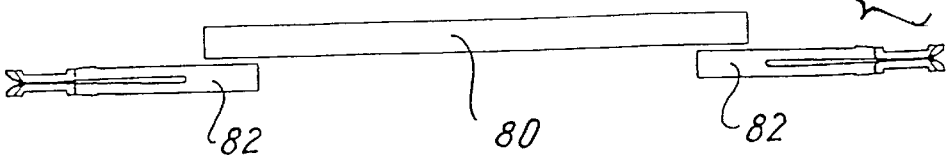
Fig.11g
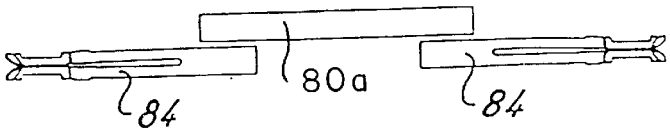

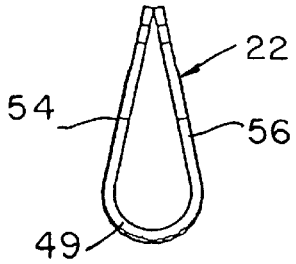
Fig. 12a
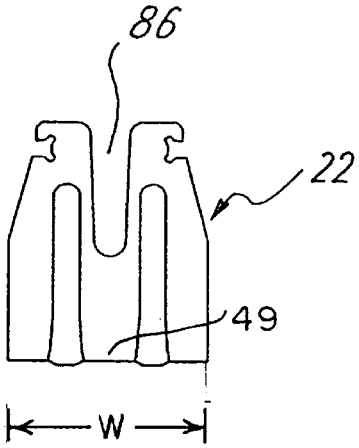
Fig. 12b
Fig. 12c
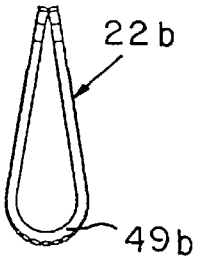
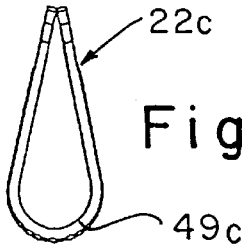
Fig. 12d
Fig. 12e
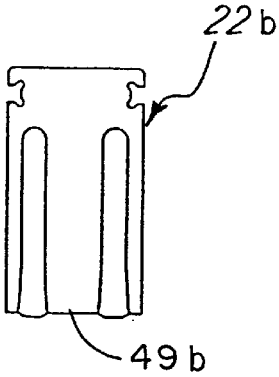
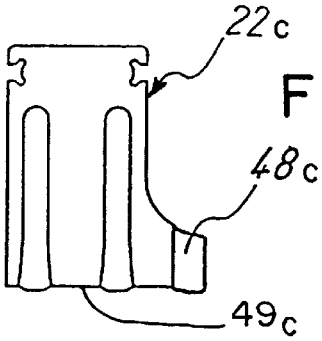
Fig. 12f

TERMINAL BLOCK WITH DISCONNECT CONTACT AND TERMINAL ARRANGEMENT

REFERENCE TO RELATED APPLICATION

This application is a companion application to the U.S. application of Manfred Wilmes, et al., Ser. No. 09/950,602 filed Sept. 13, 2001, entitled "Terminal Block with Disconnect Contacts and Contact Operating Means".

FIELD OF THE INVENTION

A terminal block assembly includes an actuator member that is displaceable relative to a terminal block to transport an insulated conductor into engagement with the knife edges of a stationary electrical contact on the terminal block, thereby to effect penetration of the insulation and electrical connection between the conductor and the stationary contact, characterized by the provision of a U-shaped support spring having leg portions between which the stationary contact is supported.

BACKGROUND OF THE INVENTION

Brief Description of the Prior Art

A terminal block with a connecting device that penetrates the insulation layer of an insulated conductor is disclosed in the German published application No. 196 27 209. The connecting device illustrated in this publication features contact cutters with cutting edges that widen to form contacting surfaces. The contacting surfaces facilitate a larger-surface contacting of the line lead(s) of the connected electrical conductor than do the actual contact cutters used in severing the conductor, which essentially touch the conductor in a "linear fashion."

The solution offered in German Patent No. DE 197 32 182 C1 proved effective in order further to support the outside resiliency of the connecting devices. This publication discloses, among other things, a cutting terminal contact with a contact spring having two elastic contact legs that define a contact slit where a U-shaped support spring is provided that has plate-shaped spring legs. The U-shaped support spring or overspring is designed as a part that is separated from the actual contact or the resilient contact. The plate-shaped spring legs essentially are aligned normal to the cutting terminal or the contacting areas of the contact legs and encompass the latter along the contact slit over a predetermined width.

European Patent No. EP 0 936 697 A1 discloses a typical terminal block. The contact springs are made each time on both ends of a bus bar, which is so aligned in the housing made of insulation material that the insertion openings of the two resilient stationary contacts point away from each other, that is to say, a conductor is introduced into the resilient contact from the outside with relation to the mounting rail. To make the actual introduction of the conductors into the contact springs easier, there are provided contact activation pieces that are arranged on the top of the housing that is made of insulation material. The contact activation pieces are made in the form of a slide and are inserted in the housing made of insulation material from the outside upon first assembly. Each has a conductor introduction opening, and under an essentially U-shaped recess in the foot area, it has lateral catch surfaces as well as a deep stop for the conductor.

Dovetail-like guides are made in the upper opening area of the housing made of insulation material; the contact activation piece is guided in a movable manner on these guides with bilaterally corresponding dovetail grooves. The contact activation piece can be shifted by means of a screwdriver between a conductor insertion position and a contacting position and these two positions are defined by a catch position.

This terminal block and its connecting devices generally have proven to be effective. For various practical purposes, however, it is desirable to so develop the design structure of the terminal block and the connecting device that one can make terminal blocks with particularly small dimensions. In particular, the dimensions of the metal subassembly of the connecting device should be made as compact as possible, and the forces that are introduced into the insulation material housing of the terminal block should also be kept as small as possible. The task of the present invention is to solve this problem.

SUMMARY OF THE INVENTION

Accordingly, a primary object of the present invention is to provide a terminal block assembly including a U-shaped support spring have leg portions that extend on opposite sides of the stationary electrical contact to support the same during the displacement of an insulated conductor by an activator member toward and away from the insulation-severing knife edges of the stationary contact. In this manner, the stationary contact is supported within the terminal block housing against the forces applied thereto during the severing of the conductor insulation by the knife edges.

According to another object of the invention, in one embodiment, the bus bar extends through the U-shaped support spring adjacent the lower base portion thereof. The bus bar then extends upwardly and is reversely bent back inwardly over the bus bar with the stationary spring contact being supported between the upper ends of the leg portions of the support spring. In another embodiment, the bus bar extends in supporting relation under the base portion of the support spring, and a second bus bar section carries the reversely bent portion that supports the stationary resilient contact between the upper ends of the leg portions of the U-shaped support spring.

According to a further object of the invention, the actuator member that displaces the insulated conductor toward and away from the knife edges of the stationary contact are guided by guide pin and groove means for pivotal or linear movement relative to the terminal block housing. The guide pins extend laterally from the actuator for engagement with the guide grooves contained in opposing walls of the terminal block. Both the actuator member and the terminal block are formed from electrically insulating synthetic plastic material. The guide means prevent jamming of the actuator relative to the terminal block, and the length of the guide grooves may be reduced as compared with a pure shifting of the actuator member without any guide means.

Another object of the invention is to arrange the stationary resilient contacts on inwardly directed end portions of the bus bar, with the respective actuator members being arranged between the stationary contacts. In this manner, only pressure forces act on the actuator members during the displacement thereof between their engaged and disengaged portions relative to the stationary contacts.

A further object of the invention is to provide the stationary contacts with lateral recesses for receiving the upper ends of the support springs, and to provide the support spring legs with notches for receiving corresponding shoulders of the stationary contacts.

BRIEF DESCRIPTION OF THE DRAWINGS

Other objects and advantages of the invention will become apparent from a study of the following specification when viewed in the light of the accompanying drawings, in which:

FIGS. 7*a*–7*g* are end views of various support springs illustrating their tear-drop cross-sectional configuration when in their unstressed normal and outwardly stressed conditions, respectively.

FIGS. 9*a* and 9*b* are side elevation and end views, respectively, of a bus bar having an added extension section, and FIG. 10 is a top view of the bus bar of FIG. 9*a* without the extension;

FIGS. 11*a*–11*g* illustrate different types of sectional bus bar arrangements;

FIGS. 12*a*–12*f* are end and side elevation views of three additional support spring embodiments;

DETAILED DESCRIPTION

Figure 1A:
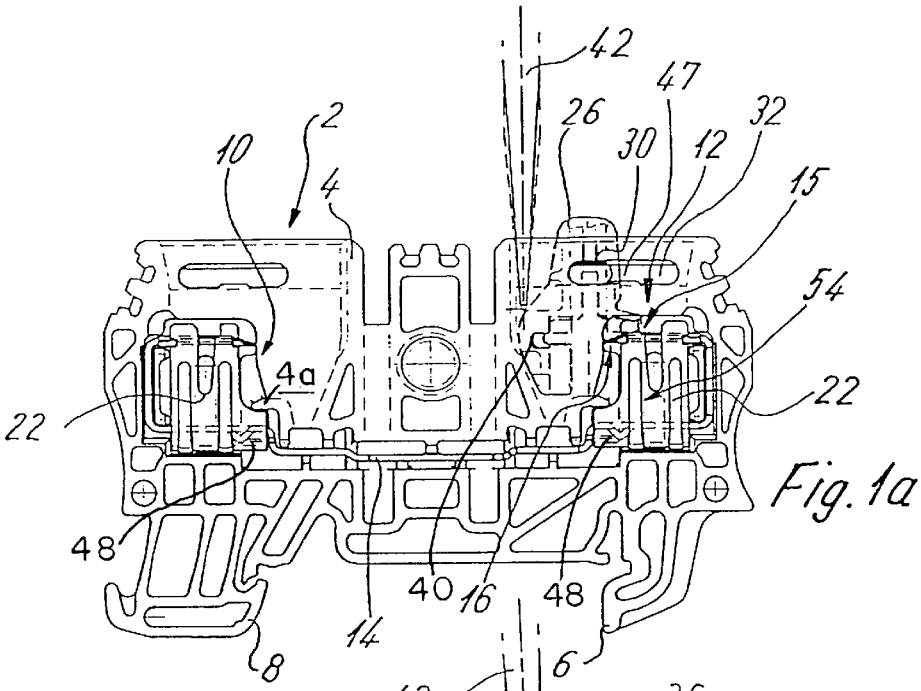
FIGS. 1*a*–1*e* are side elevational views of the terminal block illustrating the manner of operation of the actuator member from the disengaged position toward the engaged position, thereby to displace an insulated conductor toward the knife edges of the stationary resilient contact.
Figure 1B:
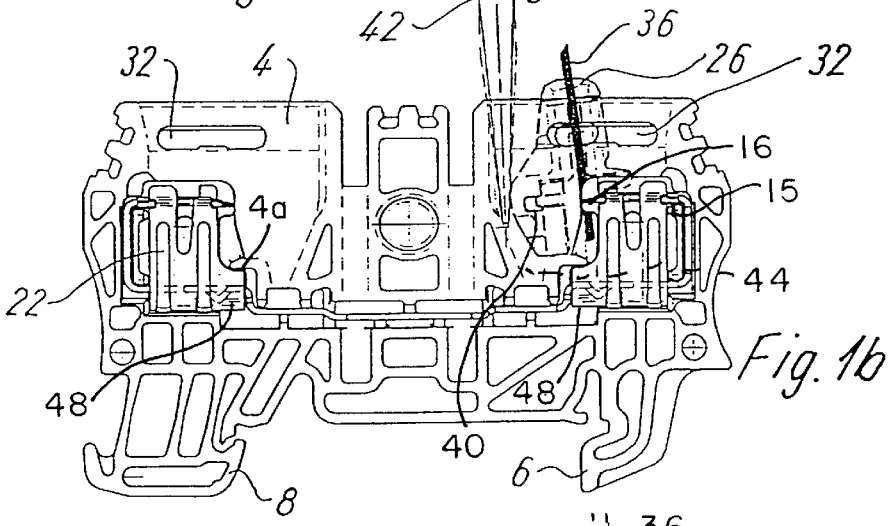
Figure 1C:
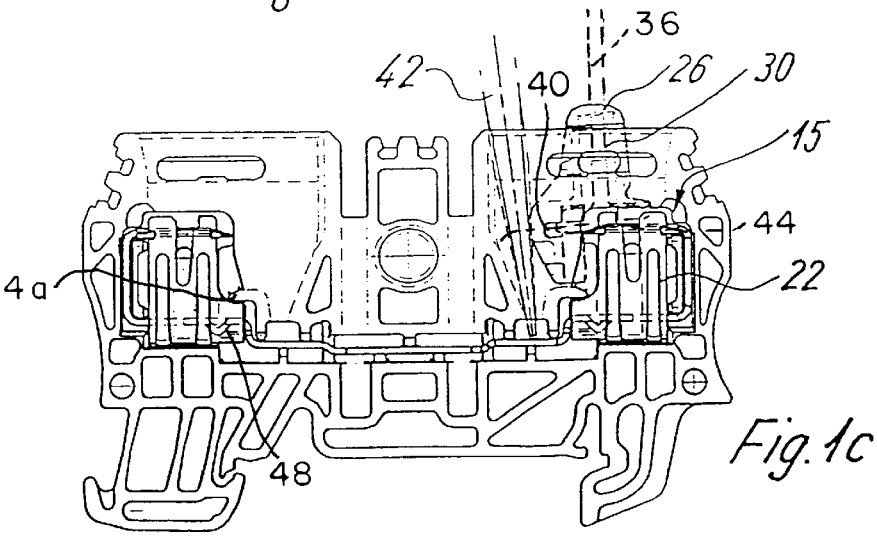
Figure 1D:
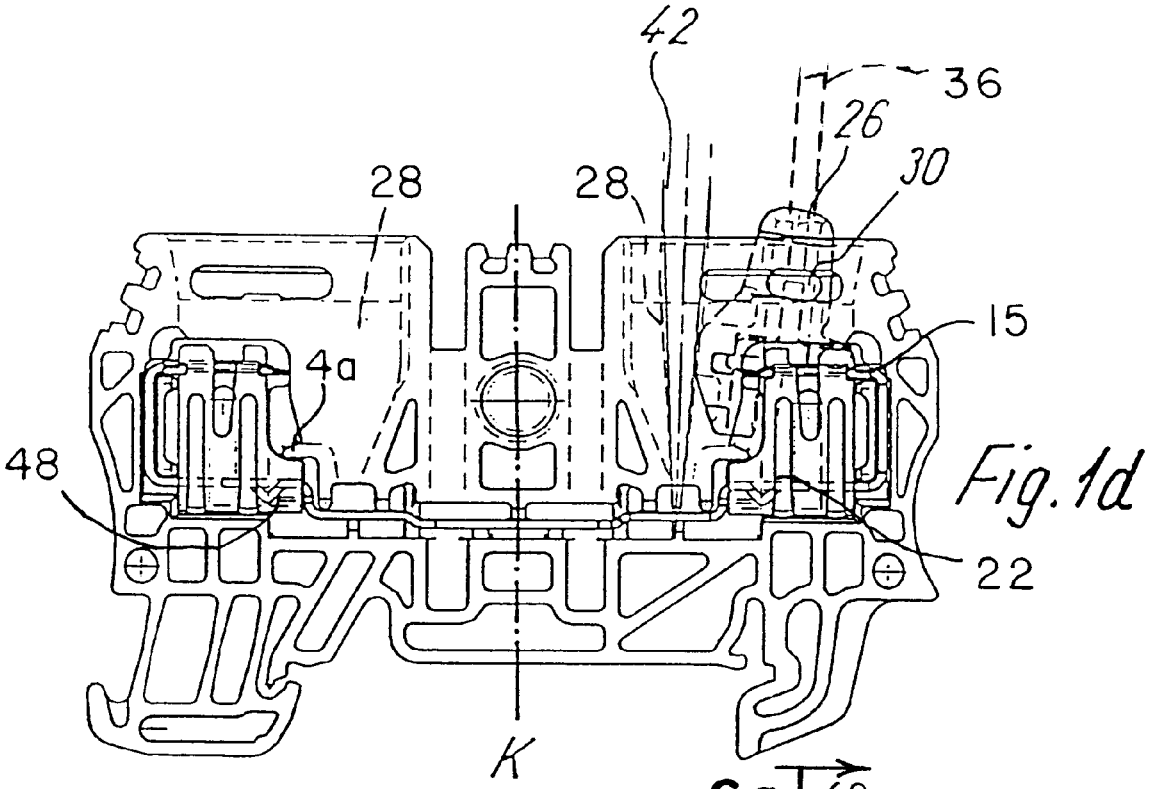
Figure 1E:
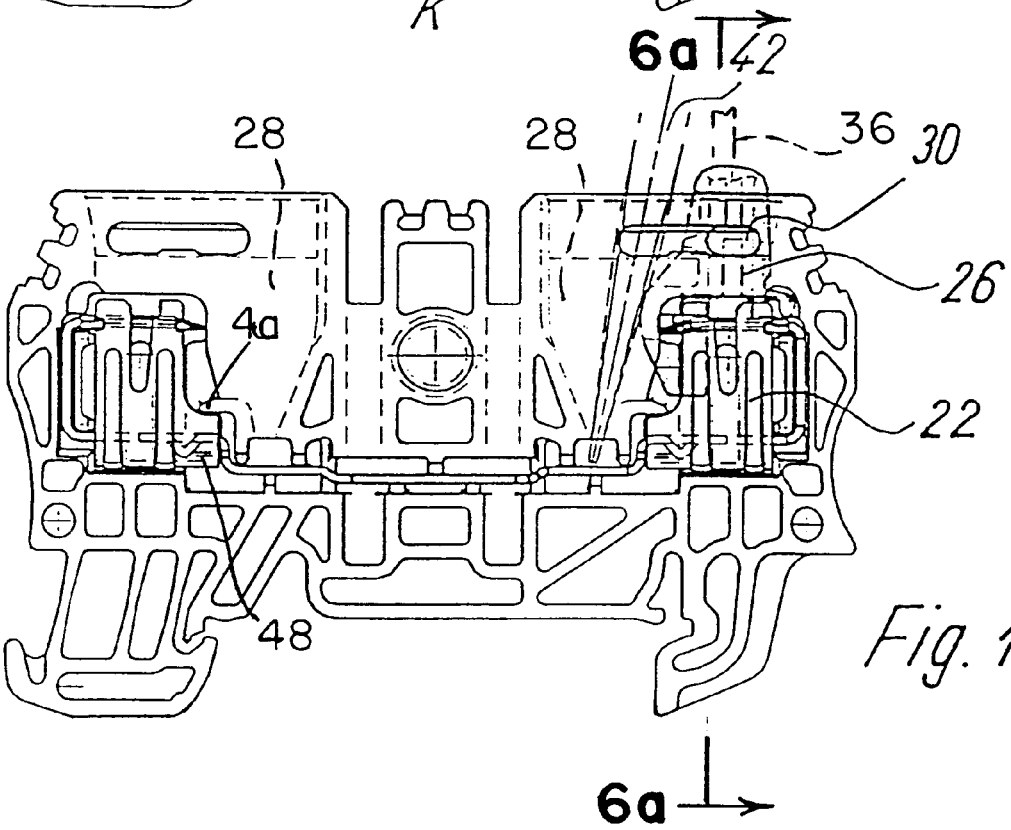

Referring first more particularly to FIGS. 1*a*–1*e*, the terminal block assembly 2 of the present invention includes a terminal block 4 that is formed of synthetic plastic insulating material and within which is mounted a bus bar 14 that extends between electrical connections 10 and 12 at opposite ends of the terminal block. The bus bar 14 carries a pair of inwardly directed opposed stationary resilient contacts 15 the adjacent extremities of which are provided with knife edges 16 that are operable to penetrate the insulation layer of electrical conductors 36 that are associated with the connector means 10 and 12, respectively. As will be explained in greater detail below, in accordance with a characterizing feature of the invention, a pair if U-shaped resilient support springs 22 are provided at each of the connector means 10 and 12 for laterally supporting the stationary contacts 15 relative to the terminal block housing 4, respectively. Moveably mounted within chambers 28 (FIG. 4*b*) at opposite ends of the housing 4 are a pair of actuator members 26, as shown in FIGS. 4*a* and 4*b*. When the actuator member 26 is in the disengaged position of FIG. 1*a*, an insulated conductor 36 may be longitudinally inserted within a bore 34 (FIG. 3*c*) that extends vertically through the actuator member 26. When an operating tool 42 (such as the tip of a screwdriver) is inserted into chamber 28 on the left hand side of the actuator member 26, the actuator member is pivotally connected in the clockwise direction to displace the conductor 36 toward the knife edges 16 of the stationary spring contact 15. As the tool 42 is progressively inserted within the opening contained in the housing 4, the tip of the tool engages an inclined internal surface 44 of the housing, and progressively pivots the actuator member 26 to the right to the position of FIG. 1*c*, wherein the knife edges 16 penetrate the insulating layer of the conductor 36. Upon further insertion of the operating tool 42, the tip is supported adjacent the bus bar 14 as shown in FIG. 1*c*, and further displacement of the tool to the right causes pivotal movement of the operating member 26 to the right to the fully engaged position of FIG. 1*e*. As will be described in greater detail below, during this movement of the actuator 26 and the conductor 36 relative to the stationary contact 15, the stationary contact is laterally supported by the upper extremities of the legs of the U-shaped support spring 22.

Figure 2A:
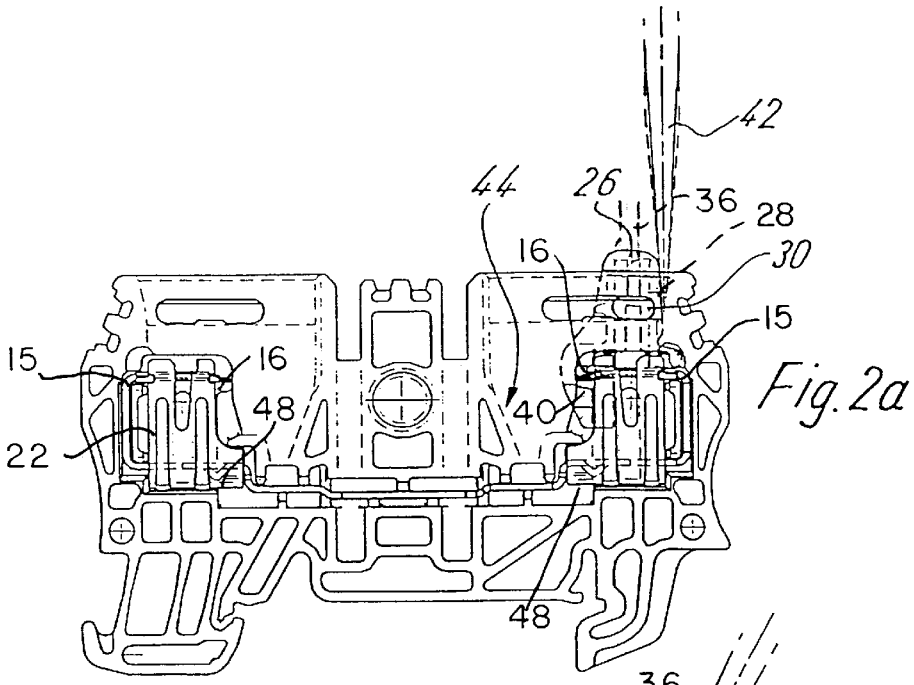
FIGS. 2*a*–2*c* illustrate the displacement of the actuator member from the engaged position toward the disengaged condition.
Figure 2B:
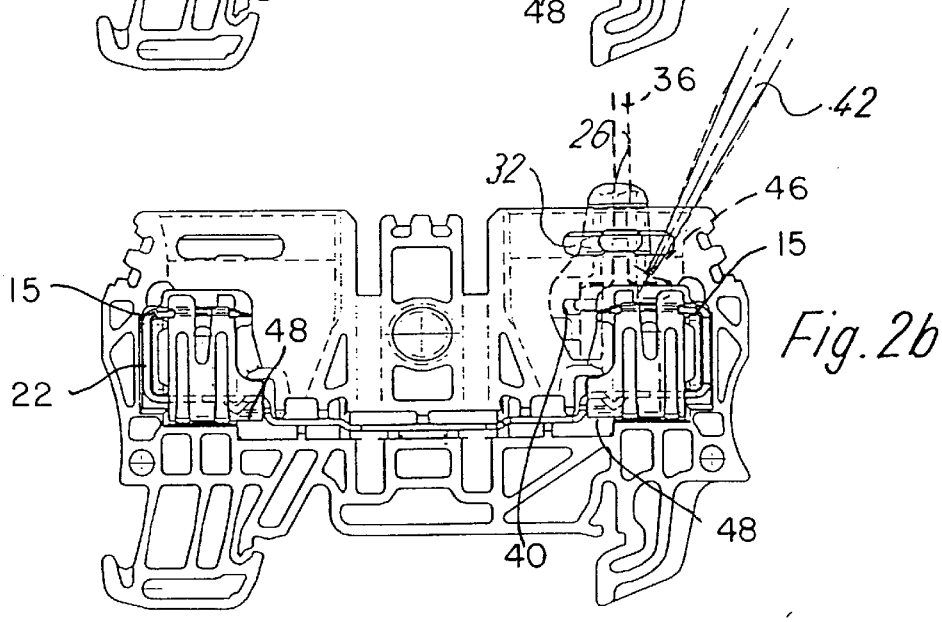
Figure 2C:
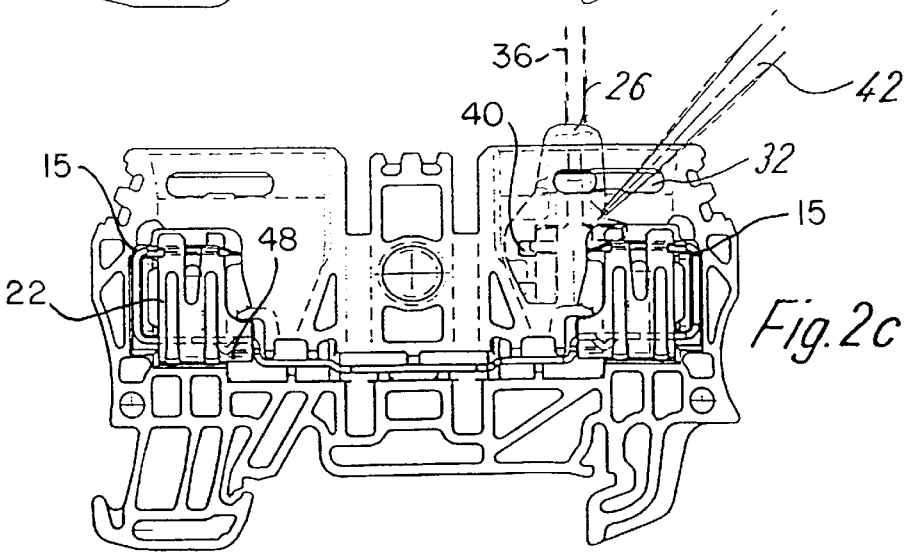

Similarly, as shown in FIGS. 2*a*–2*c*, if the tip of the operating tool 42 (such as a screwdriver) is inserted to the right of the actuator member 26 in the fully engaged position of FIG. 2*a*, the operating tool may be pivoted to the right as shown in FIG. 2*b*, thereby to displace the actuating member to the left together with the conductor 36 carried thereby, and thus effect disengagement of the conductor from the stationary resilient contact 15. When the actuator member 26 is completely pivoted to the left to the disengaged position of FIG. 2*c*, the conductor 36 is released from the stationary contact 15 for vertical removal from the actuating member 26.

Figure 3A:
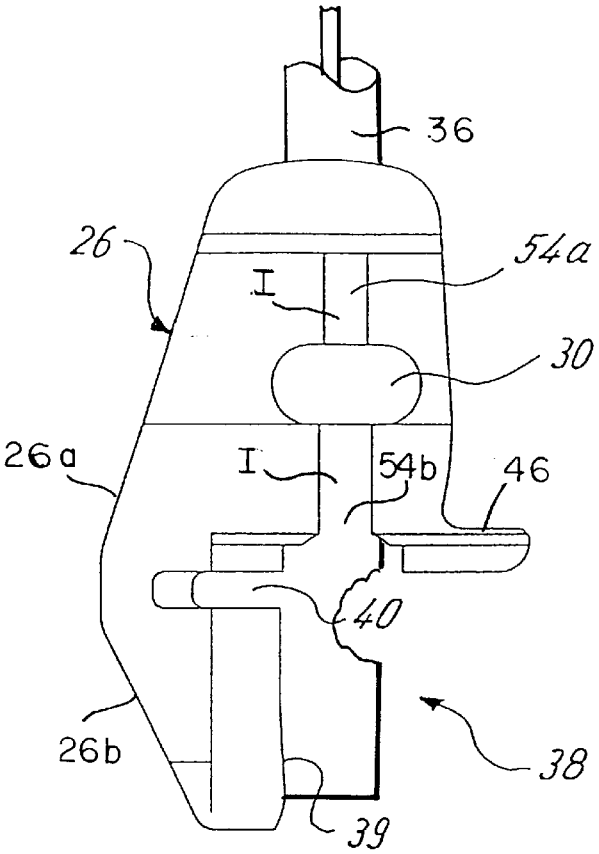
FIGS. 3*a*–3*c* are side elevation, end, and top views, respectively. of the actuator member of FIG. 1.
Figure 3B:
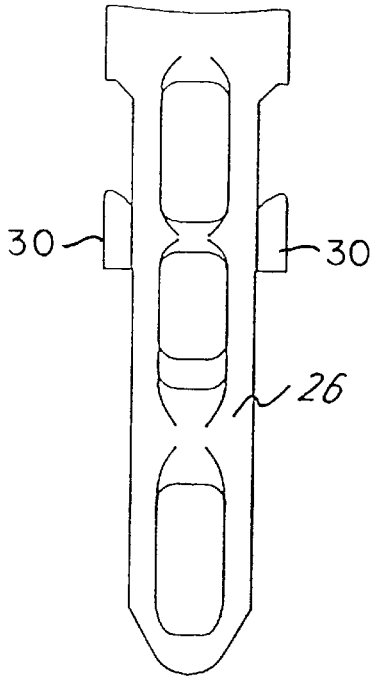
Figure 3C:
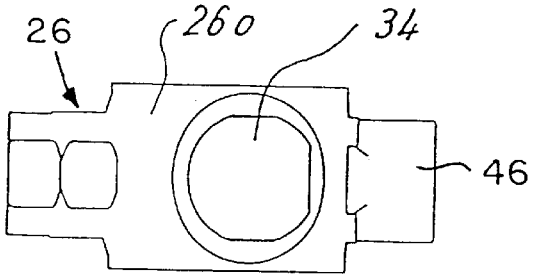
Figure 4A:
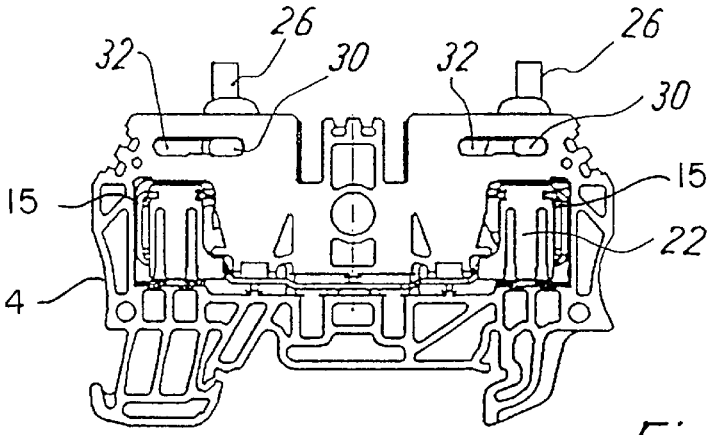
FIGS. 4*a* and 4*b* are side elevation and exploded views, respectively, of the terminal block assembly of FIG. 1.
Figure 4B:
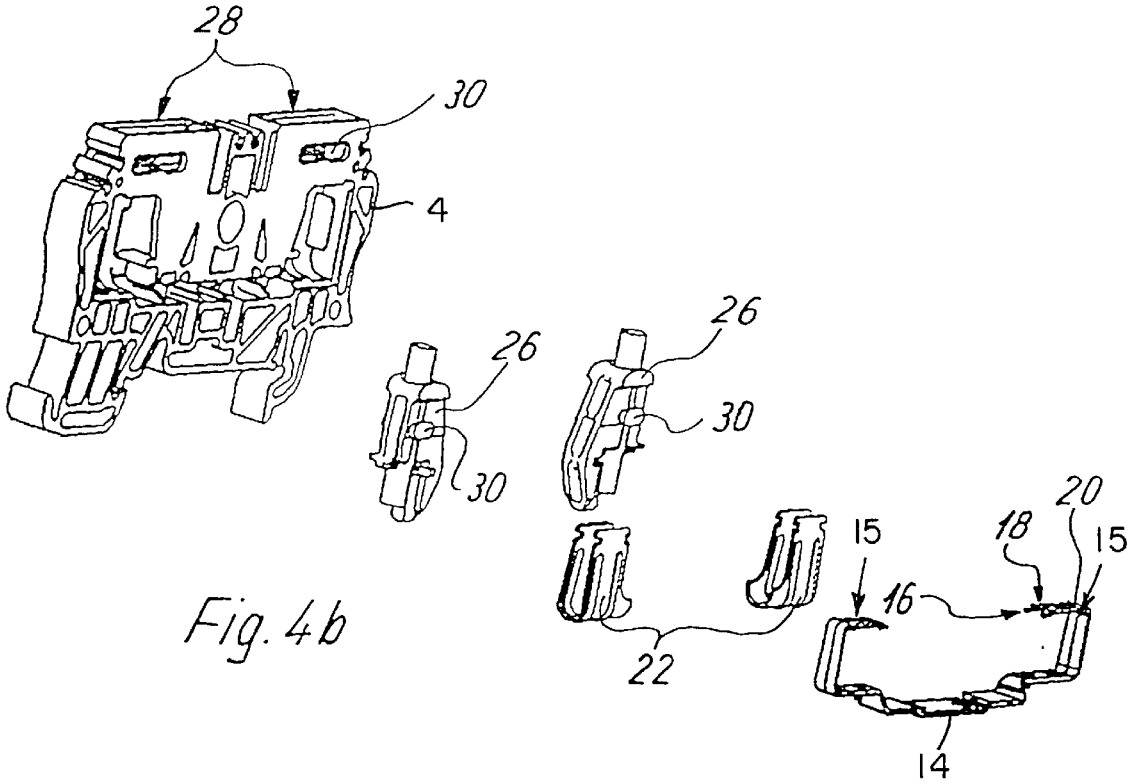

Referring now to FIGS. 3*a*–3*c*; the actuator member 26 includes an upper portion 26*a* that contains a vertical bore 34, for receiving the insulated conductor 36, as well as lateral slots 54*a* and 54*b* for receiving the insulated outer circumferential surface I of the conductor 36. Laterally extending outwardly from opposite sides of the actuator member 26 are a pair of guide pins 30 that extend within corresponding guide grooves 32 contained in the opposite walls of the housing chambers that receive the actuator members 26, respectively. The lower end portion 26*b* of the operating member 26 includes a vertical conductor support wall 39 that contains groove 40 for receiving the knife edges 16 when the actuator member is in the fully engaged position.

As shown in FIGS. 4*a* and 4*b*, a pair of the actuator members 26 are provided at opposite ends of the terminal block housing 4, and a pair of the support springs 22 support the stationary resilient contacts 15 within the terminal block housing 4, respectively.

Figure 5:
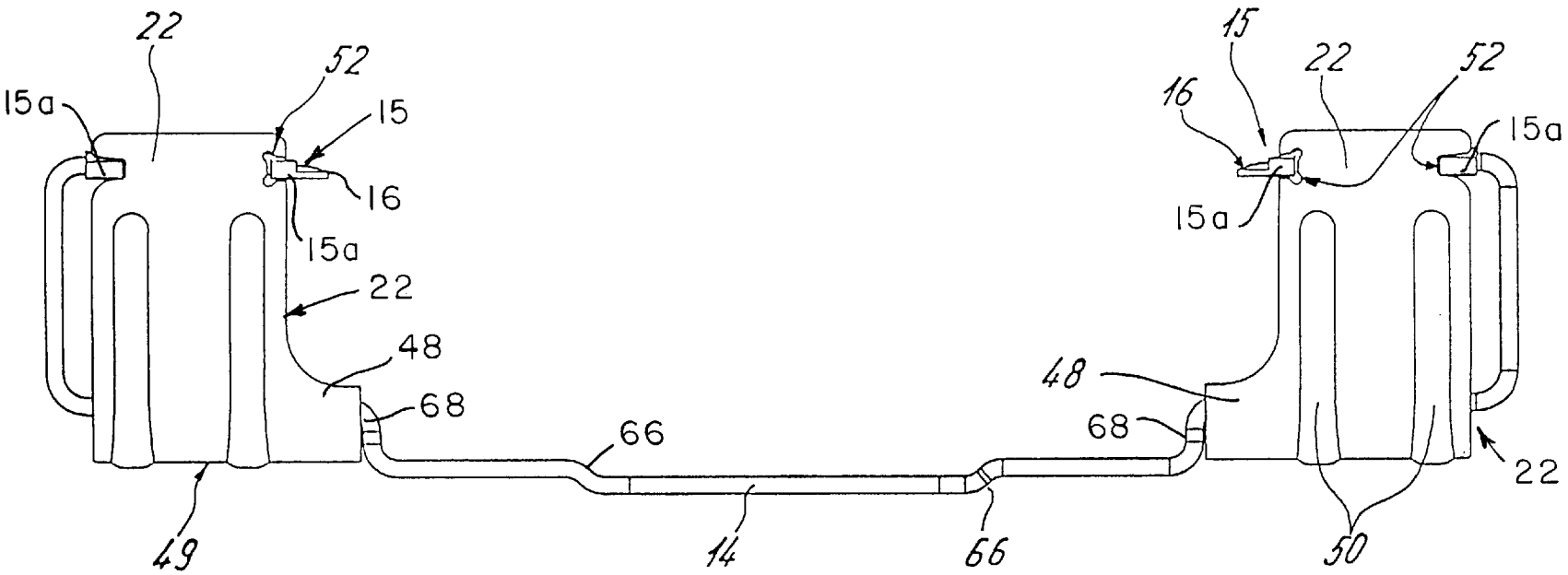
FIG. 5 is a detailed side elevation view of the bus bar and support spring assembly of FIG. 1.
Figure 6:
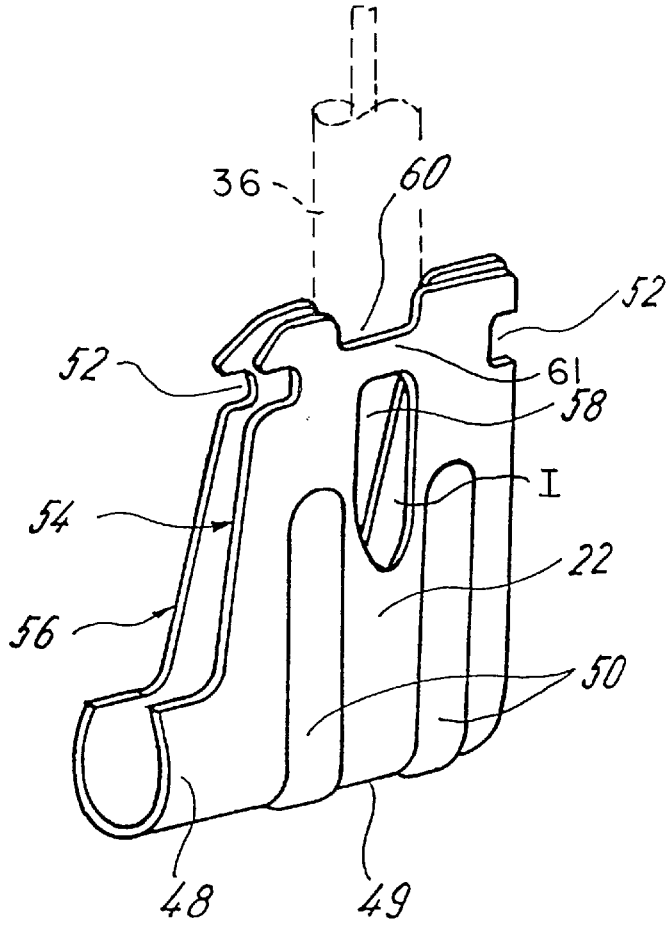
FIG. 6 is a perspective view of a modification of the support spring of FIG. 5.
Figure 6A:
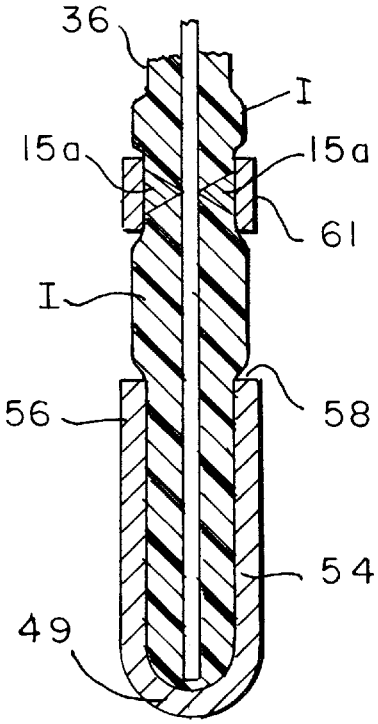
FIG. 6*a* is a sectional view taken along line 6*a*–6*a* of FIG. 1*e*.

Referring now to FIGS. 5 and 10, the support springs 22 are carried by reversely inwardly bent end portions of the bus bar, whereby the knife edges 16 of the stationary. resilient contact are directed toward each other. As shown in FIG. 10, the stationary resilient contacts 15 are bifurcated by a longitudinally extending slit 18 that extends within the contact portion 20 of the stationary contact. The lateral sides of the contact portion 20 of the stationary contacts 15 contain recesses 64 for receiving the upper extremities of the leg portions of the support springs 22. Similarly, as shown in FIG. 6, the leg portions 54 and 56 of the U-shaped support spring 22 contain opposed notches 52 for receiving the inwardly directed shoulder 15*a* defined by the recesses 64 on the stationary contacts 15. In the embodiment of FIG. 5, the bus bar extends within the U-shaped support spring 22 adjacent the base portion 49 thereof. The support spring may be strengthened by stiffening deformations 50 that extend upwardly within the leg portions 54 and 56 of the support spring. As shown in FIGS. 6 and 6*a*, the leg portions contain openings 58 for receiving a lateral portion of the circumferential surface of the insulation layer I of the conductor 36 that is inserted downwardly within the bore 34 contained within the actuator member 26, thereby to stabilize the conductor relative to the support spring 22. An upper recess 60 is contained in the upper edge of the leg 54 which cooperates with the opening 58 to define a bridge portion 61 that extends adjacent the stationary resilient contact 15.

Figure 8:
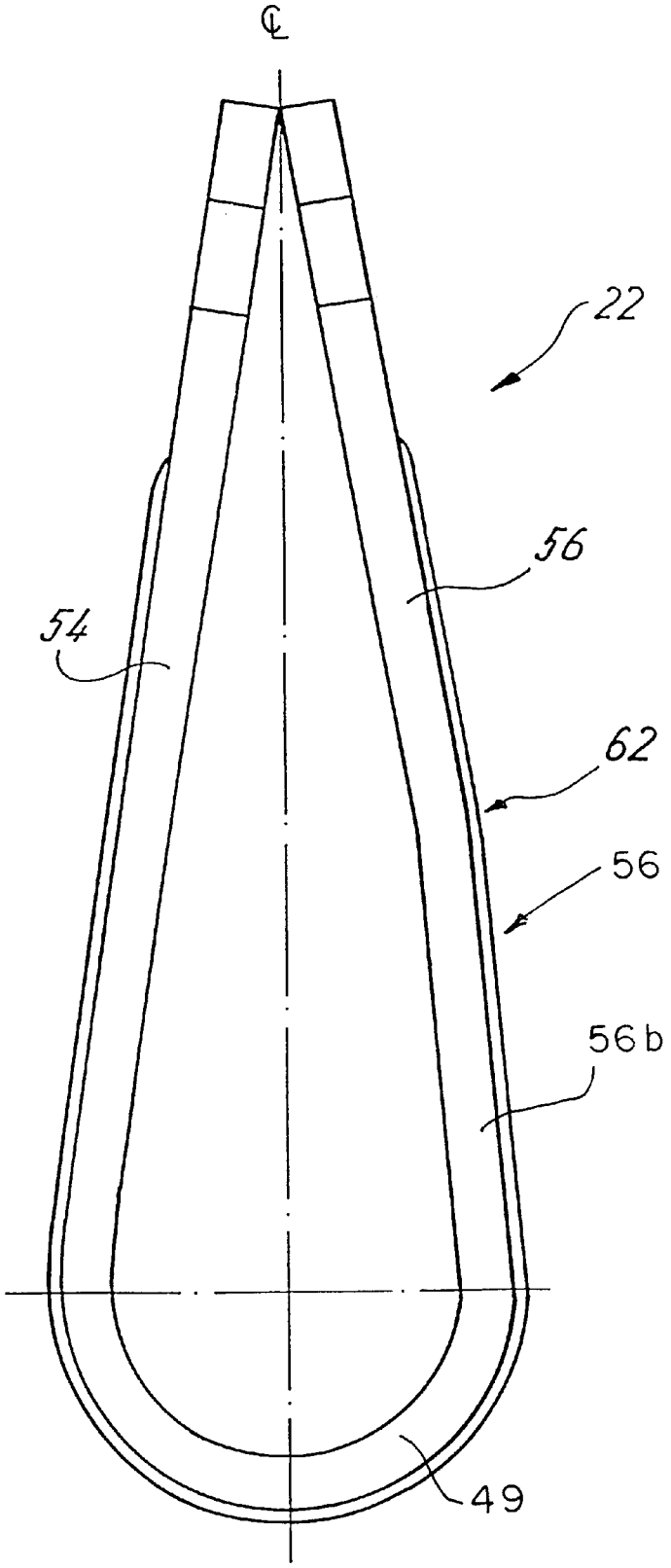
FIG. 8 is an end view of another embodiment of support spring.

Referring now to FIGS. 7 and 8, it will be seen that in transverse cross section, the support springs 22 have a generally tear-drop configuration. In the embodiment of FIGS. 7*a* and 7*b*, the leg portions 54 and 56 are generally planar and extend inwardly on opposite sides of the vertical central plane C that extends through the terminal block housing. Thus, when the stationary contact 15 is supported between the legs as shown in FIG. 7*b*, the legs 54 and 56 have a generally concave configuration. Alternatively, when the leg portions 54 and 56 are initially provided with a convex bulge configuration as shown in FIG. 7*c*, when the leg portions are separated by the stationary contact 15, the legs have a generally straight configuration, as shown in FIG. 7*d*. Similarly, as shown in FIGS. 7*e* and 7*f*, when the convex bulge legs 54 and 56 are separated by the stationary contact 15 as shown in FIG. 7*g*, the leg portions 54 and 56 are generally planar and parallel with each other. In the embodiment of FIG. 8, the leg 56 is bent about a bending edge 62 to define upper leg section 56*a* and lower leg section 56*b*, respectively.

Referring to FIGS. 9*a*, 9*b*, and 10, the bus bar 14 may be provided with stepped portions 66 and 68 that strengthen the bus bar and provide means for connecting bus bar extensions 70 in accurately positioned relation thereto. The additional stationary contact 15' carried by extension 70 is directed inwardly toward the central plane of the bus bar. In FIG. 10, the additional bus bar extension 70 has been omitted.

Referring now to FIGS. 11*a* and 11*b*, it will be seen that the bus bar 14, which is formed from a sheet of conductive material, such as copper, includes a plurality of reversely bent portions 14*a* provided with stationary resilient contacts 15, respectively. In the embodiment of FIG. 11*a*, four springs are provided on two pairs of reversely bent portions at opposite ends of the bus bar. As shown in FIG. 11*b*, the bus bar 14 includes a pair of lateral wing extensions 14*a* that are separated from the bus bar portion 14 by a pair of scored bending lines 76. Thus, when the lateral wing extensions 14*a* are folded back upon the main bus bar portion 14 and the reversely bent resilient contact portions are folded to the configuration of FIG. 11*a*, a single bus bar carries four electrically connected stationary contacts 15. In the embodiment of FIGS. 11*c*—11*e*, a pair of bus bar members 14 and 78 of unequal length are provided. In this embodiment, the shorter bus bar 14 is secured by soldering the like to the longer bus bar portion 14, and the resilient stationary contacts 15 are bent inwardly from opposite ends of the assembly, as shown in FIG. 11*c*.

Referring now FIGS. 11*e* and 11*f*, it will be seen that the bus bar assembly of FIG. 11*f* may be provided by using a longer bus bar section 80 in combination with two pairs of stationary resilient contact sections 82 and 84. Alternatively, when a bus bar is desired to having only two stationary resilient contacts, a shorter bus bar length 80*a* is utilized in connection with only two bus bar sections 84. As shown in FIGS. 5*a* and 9, the bus bar 14 may be provided with stepped portions 66 and 68 that serve to strengthen the bus bar. The support springs 22 are provided with inwardly directed longitudinal extensions 48. that extend from the base portion 49 toward the stepped portion 68 of the bus bar, thereby to further laterally strengthen and support the connection between the support spring 22 and the bus bar. As best shown in FIGS. 1*a*–1*e*, the spring extension portions 48 terminate adjacent the corresponding ledge portions 4*a* of the terminal block 4.

Figure 13:
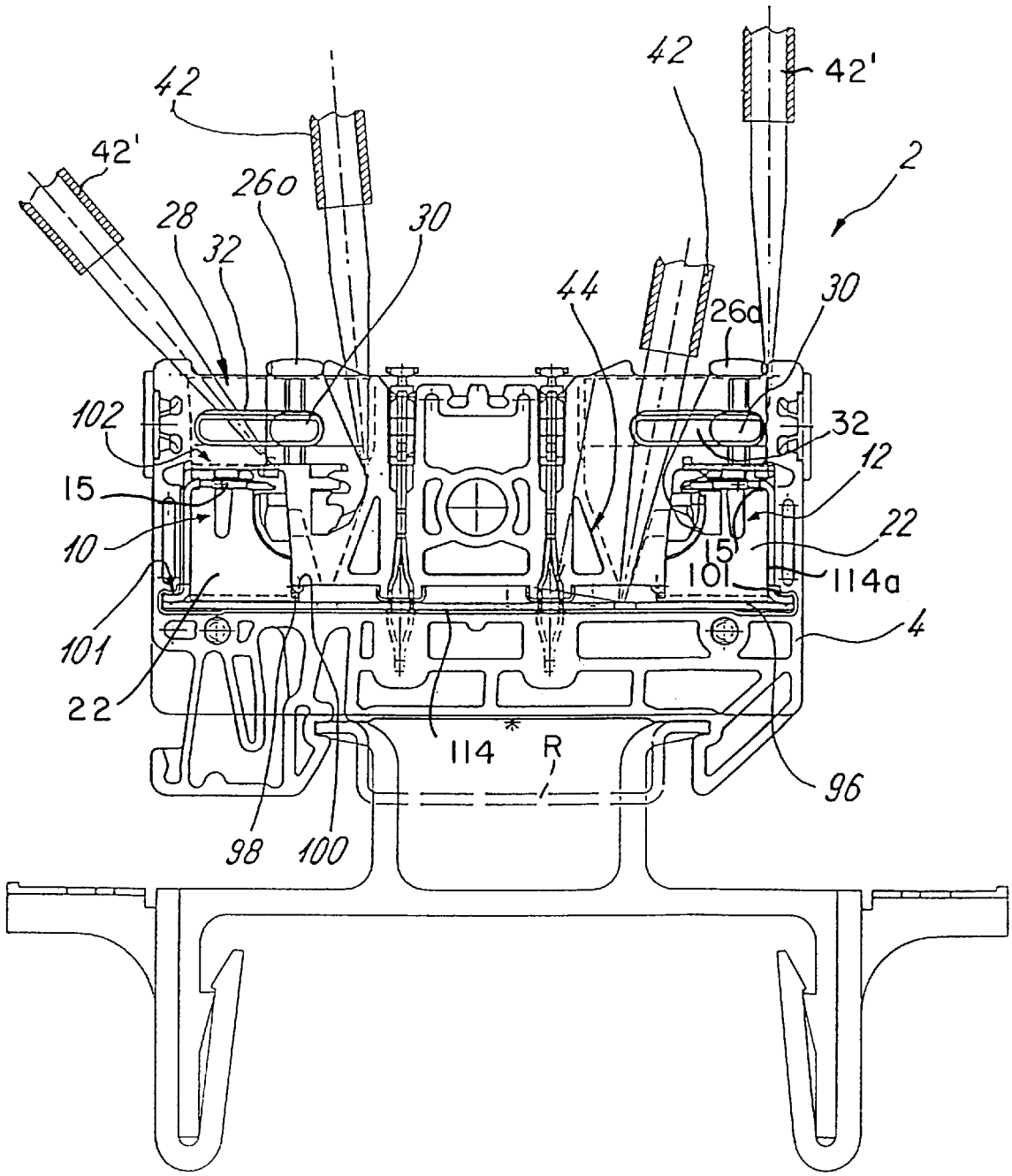
FIG. 13 is a side elevational view of a second embodiment of a terminal block assembly according to the present invention.
Figure 14:
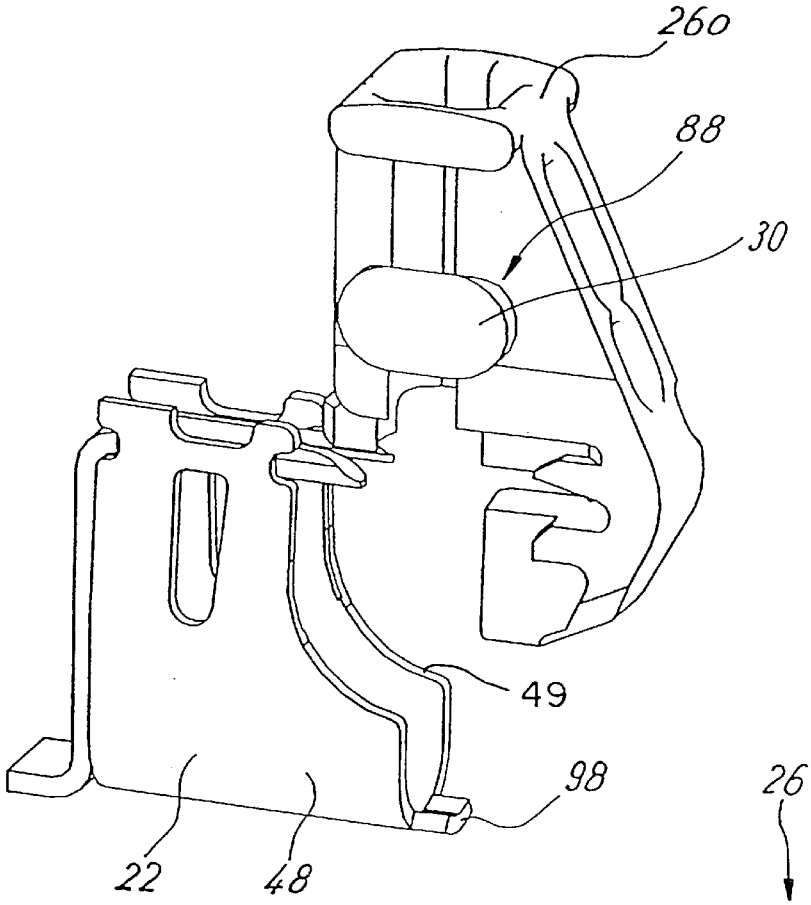
FIG. 14 is a detailed exploded view illustrating the cooperation between the support spring and the actuator member.

As shown in FIGS. 13 and 14, the extension portion 48 may be provided with a protrusion 98 that extends beneath an abutment 100 within the terminal block housing 4, thereby to further retain the support spring 22 within the terminal block housing 4. As shown in FIG. 12, the leg portions 54 and 56 of the support spring 22 may be provided with downwardly extending recesses 86 for receiving the conductor insulation. The support spring 22*b* may have a relatively narrow width as shown in FIGS. 12*c* and 12*d*, and may be provided with a longitudinal extension 48*c* as shown in FIG. 12*f*.

Referring now to the embodiment of FIG. 13, the bus bar 114 extends externally beneath the base portion 49 of the support springs 22. In this embodiment, separate bus bar sections 114*a* are secured to, the ends of the main bus bar 114. The configuration of the bus bar sections 114*a* is shown in FIG. 17, with the lower extremity 114*b* extending beneath the abutment 101 (FIG. 13) formed within the terminal block housing 4. Thus, the sections 114 a of FIG. 17 are supported in relation to the ends of the bus bar 114 to which these sections are connected, for example,by soldering or deformation.

Figure 15:
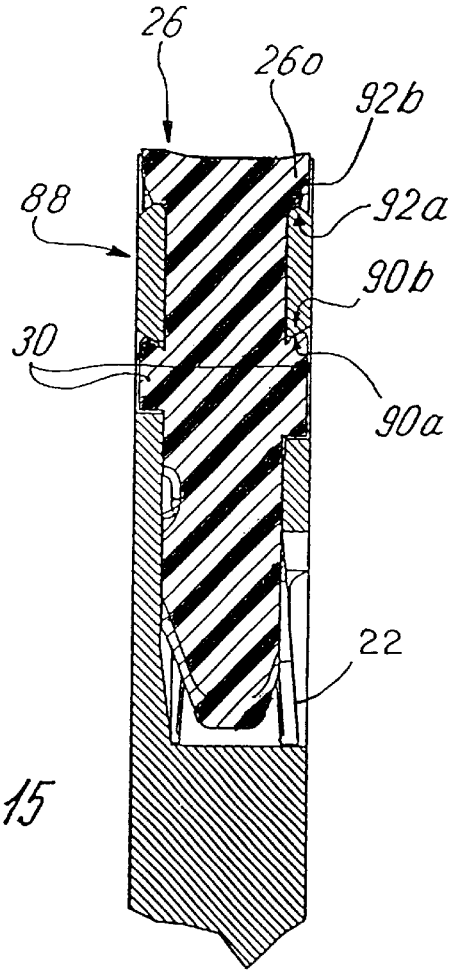
FIG. 15 is a detailed sectional view illustrating the dove-tail sliding connection between the actuator member and the terminal block.
Figure 16:
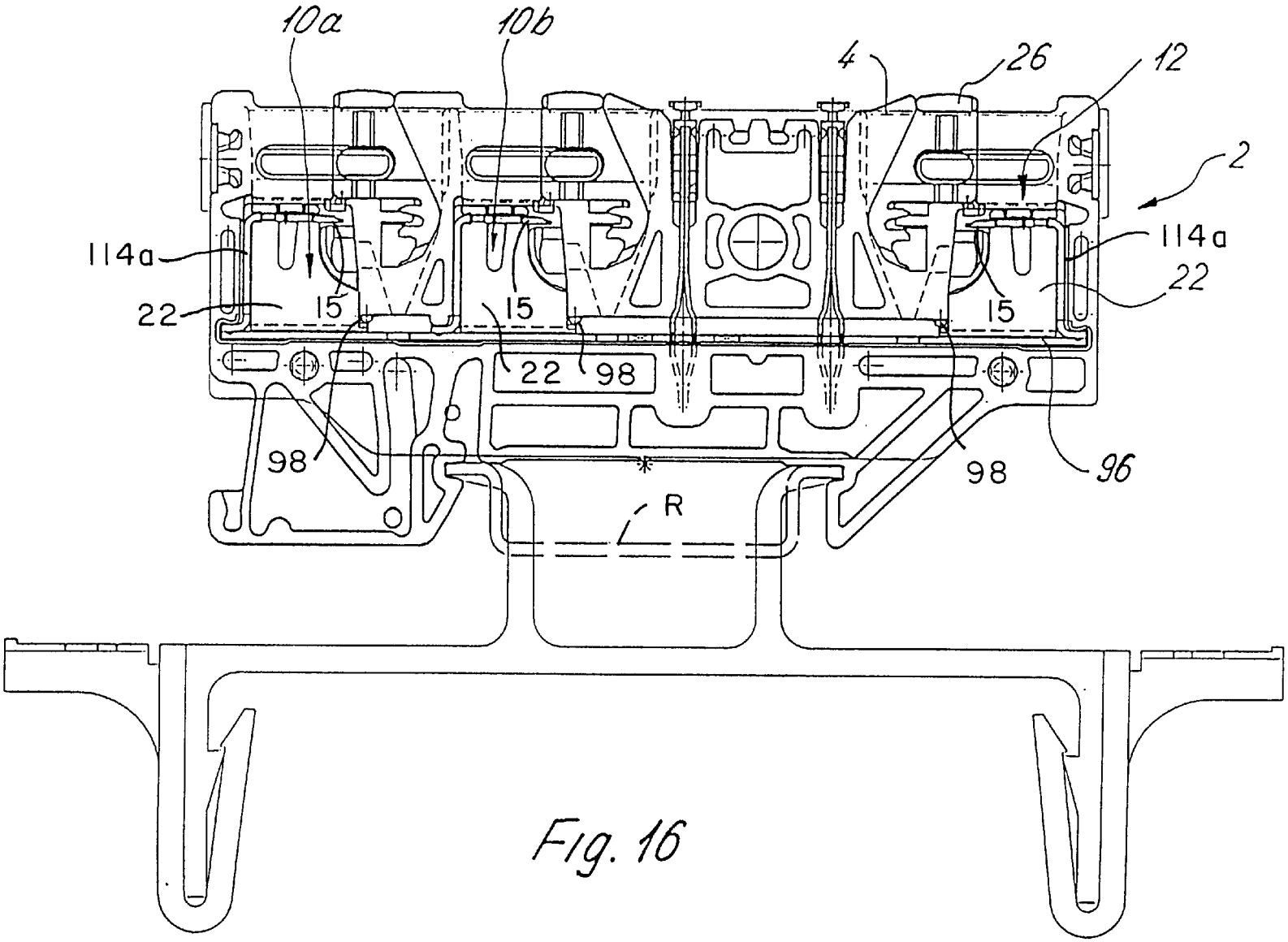
FIG. 16 is a side elevational view of a further embodiment of the invention.

In the embodiment of FIG. 13, the actuator members 26*a* are connected for linear sliding movement relative to the terminal block body 4. As shown in FIG. 15, the connection between the lateral extensions 30 of the actuating member 26*a* and the corresponding slots 32 contained within the walls of the, terminal block 4 may have a dovetail relation. As shown in FIG. 15, the beveled edges of the male member 92*a* engage corresponding guide surfaces 90*b* carried by the opening 32 defined within the terminal block 4. As described above, the actuating members 26*a* may be linearly displaced between their engaged and disengaged positions by means of the tip of a screwdriver 42 or other operating tool. As before, the screwdriver tip slides down the inclined guide surface 44 during displacement of the actuator members toward their engaged positions, and the tool operating means 42' may be inserted in the other ends of the operating chambers 28 to displace the operating members toward their disengaged positions relative to the stationary resilient contact 15. As is known in the art, the terminal block assembly 2 is mounted on a support rail R as-shown in FIG. 13. In the embodiment of FIG. 16, linear bus bar 96 extends generally the length of the terminal block assembly 2, and a plurality of separate bus bar sections 114*a* are connected with the main bus bar section 96 to support the various inwardly directed stationary contacts 15, respectively. In accordance with the present invention, the stationary contacts 15 are supported by support springs 22 having protrusions 98 that extend between corresponding abutments 100 defined within the terminal block housing 4.

Figure 17A:
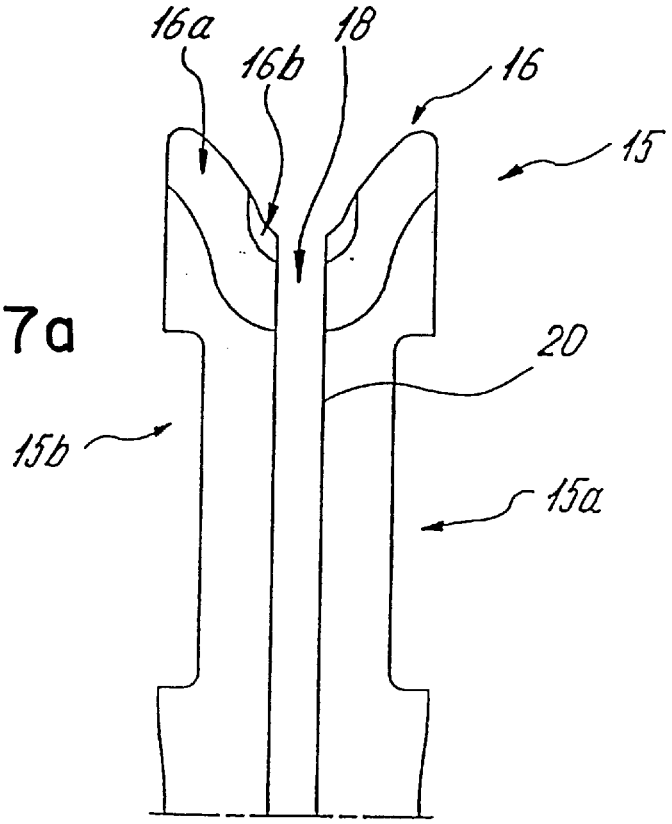
FIGS. 17*a* and 17*b* are top views of two further stationary resilient contacts.
Figure 17B:
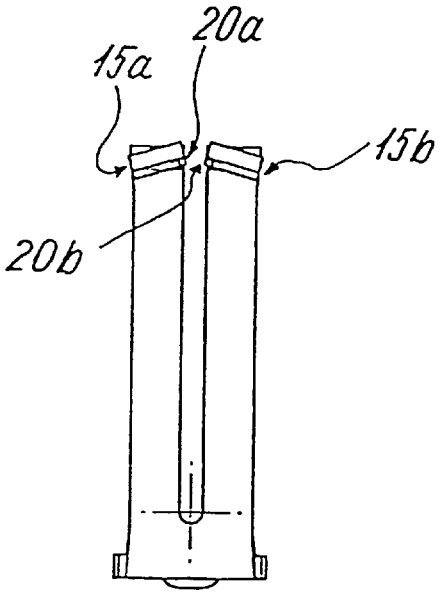
Figure 17C:
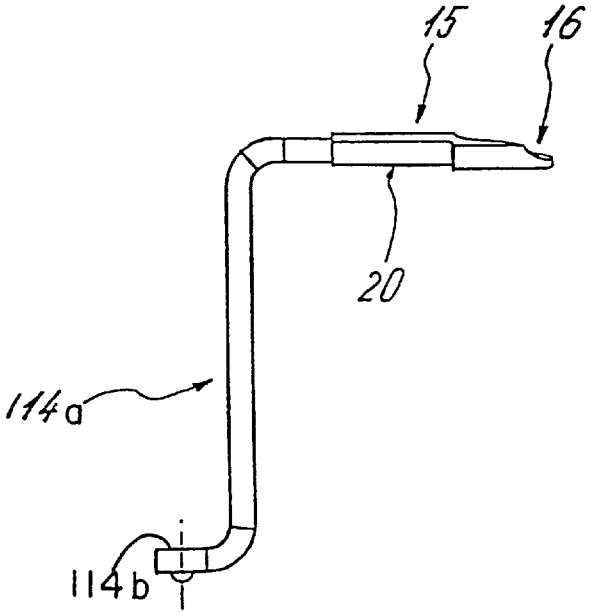
FIG. 17*c* is a detailed view of a stationary resilient contact mounted on a bus bar section.

Referring now to FIGS. 17*a* and 17*b*, portions 15*a* and 15*b* of the stationary contact on opposite sides of the longitudinal slit 18 may be inclined slightly about their longitudinal axes, as best shown in FIG. 17*b*. In this manner, an improved severing of the insulation layer by the knife edges 16 is achieved. Furthermore, the knife edges 16 may be provided with outer portions 16*a* and inner portions 16*b* of narrow width, as shown in FIG. 17*a*, thereby to achieve improved severing of the insulation layer by the knife edges 16.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A terminal block assembly adapted for connection with an insulated electrical conductor (36) comprising:

(a) a hollow terminal block (4) formed of synthetic plastic insulating material, said terminal block containing at least one chamber;

(b) a bus bar (14, 78, 96) mounted within said terminal block, said bus bar having a horizontal linear portion extending within said chamber;

(c) a horizontal resilient stationary electrical contact (15) supported by said bus bar within said chamber, said contact having a bifurcated end portion provided with a pair of knife edges (16) separated by a slit (18) that extends within a conductor contact portion (20) of said stationary contact;

(d) a generally U-shaped resilient support spring (22) mounted within said terminal block, said support spring including:

(1) a horizontal base portion (49) that extends in spaced relation below and parallel with said stationary contact, said horizontal base portion being adjacent and parallel with said bus bar linear portion;

(2) a pair of vertical leg portions (54, 56) that extend upwardly on opposite sides of, and in lateral supporting engagement with, said stationary contact conductor contact portion; and (3) a generally U-shaped longitudinal extension portion, (48) that extends horizontally from said base and leg portions in spaced relation below said stationary electrical contact; and (e) an actuator member (26) mounted for movement within said terminal block chamber between engaged and disengaged positions relative to said stationary contact, said actuator member containing a vertical bore (34) for receiving an end portion of the insulated conductor when said actuator member is in said disengaged position, said stationary contact being so supported within said chamber that as said actuator member is displaced toward said engaged position the conductor is laterally supported by said support spring leg portions as said conductor is progressively introduced within said stationary contact slit to cause said knife edges to penetrate the conductor insulation and to come into electrical contact with said stationary contact.

2. A terminal block assembly as defined in claim 1, wherein said spring base portion (49) is arranged below said bus bar linear portion, whereby said longitudinal extension portion (48) receives said bus bar linear portion.

3. A terminal block assembly as defined in claim 1, wherein said spring base portion (49) is arranged above said bus bar linear portion.

4. A terminal block assembly as defined in claim 1, wherein two pairs of longitudinally-spaced inwardly directed stationary contacts are arranged at opposite ends of the bus bar, respectively.

5. A terminal block assembly as defined in claim 1, wherein said support spring extension portion (48) terminates with a protrusion (98) that is in retaining engagement with a corresponding abutment (100) on said terminal block.

6. A terminal block assembly as defined in claim 1, wherein said support spring extension portion (48) terminates adjacent a corresponding ledge portion (4*a*) of said terminal block.

7. A terminal block assembly as defined in claim 1, wherein said bus bar (14) is formed from a sheet (5) of bendable conductive material, said bus bar having at least one additional bus bar section (14*a*) that is connected with said bus bar by a fold line (76), said additional section being reversely foldable about said fold line to an operative position contiguous with the upper surface of said bus bar.

8. A terminal block assembly as defined in claim 1, wherein said bus bar includes a plurality of separate bus bars (14, 78) of different lengths arranged in parallel contiguous relation, said bus bars including end portions that carry said stationary contacts (15), respectively.

9. A terminal block assembly as defined in claim 1, wherein said bus bar is sectional and includes a main horizontal section (80, 80*a*) and a plurality of vertical bus bar sections (82, 84) secured to said main horizontal section, said vertical sections having inwardly bent opposed end surfaces that carry said stationary contacts, respectively.

10. A terminal block assembly as defined in claim 1, wherein the bifurcated leg end portions (15*a*, 15*b*) of said stationary contact are inclined about their longitudinal axes relative to each other.

11. A terminal block assembly as defined in claim 1, wherein said knife edges (16) include first (16*a*) and second (16*b*) cutting areas, said second cutting area being arranged adjacent the mouth of said slit (18), said second cutting area having a thickness that is less than said first cutting area.

12. A terminal block assembly as defined in claim 1, and further wherein a pair of said stationary contacts (15) are supported by said bus bar at opposite ends of said terminal block in mutually inwardly facing opposed relation, respectively, said support spring longitudinal extension portions (48) extending inwardly toward each other in mutually inwardly facing opposed relation below said stationary contacts, respectively.

13. A terminal block assembly as defined in claim 12, wherein said bus bar includes at least one stepped portion (66, 68) intermediate its ends; and further including at least one bus bar extension section (70) connected with said bus bar.

14. A terminal block assembly as defined in claim 13, wherein said extension sections are integral with said bus bar.

15. A terminal block assembly as defined in claim 13, wherein said bus bar includes a plurality of parallel sections of different lengths, each of said bus bar sections being provided at its opposite ends with a stationary contact, respectively.

16. A terminal block assembly for connecting an insulated electrical conductor (36) with a stationary electrical contact (15), comprising:

(a) a hollow terminal block (2) formed of synthetic plastic insulating material, said terminal block containing at least one chamber;

(b) a bus bar (14, 78, 96) mounted within said terminal block;

(c) a horizontal resilient stationary electrical contact (15) supported by said bus bar within said chamber, said contact having a bifurcated end portion provided with a pair of knife edges (16) separated by a slit (18) that extends within a conductor contact portion (20) of said stationary contact;

(d) a generally U-shaped resilient support spring (22) mounted within said terminal block, said support spring including a horizontal base portion (49) that extends in spaced relation below and parallel with said stationary contact, and a pair of vertical leg portions (54, 56) that extend upwardly on opposite sides of, and in lateral supporting engagement with, said stationary contact conductor contact portion; and (e) an actuator member (26) mounted for movement within said terminal block chamber between engaged and disengaged positions relative to said stationary contact, said actuator member including an upper portion **(26*a*) arranged at a level above said knife edges, said actuator upper portion containing a vertical bore (34) for receiving an end portion of the insulated conductor when said actuator member is in said disengaged position, said actuator member including a lower portion (26*b*) extending below the level of sid knife edges, said lower portion including a vertical conductor support surface (39) containing a horizontal groove (40)** for receiving said knife edges when said actuator member is in said engaged position; said stationary contact being so supported within said chamber that as said actuator member is displaced toward said engaged position said stationary contact is laterally supported by said support spring leg portions as said conductor is progressively introduced within said stationary contact slit to cause said knife edges to penetrate the conductor insulation and to come into electrical contact with said stationary contact;

(f) at least one of said support spring leg portions containing a recess (58, 60, 86) arranged at a level lower than said knife edges for receiving a portion of the circumferential surface of the insulated end portion of the conductor when said actuator member is in said engaged position.

17. A terminal block assembly as defined in claim 16, wherein said actuator member includes a plurality of lateral openings **(54*a*, 54*b*)** that communicate with said vertical bore, said lateral openings being arranged to receive the circumferential surface of the conductor insulation at a level that is above that of said knife edges.

18. A terminal block assembly as defined in claim 16, wherein said support spring leg portions contain vertical stiffening deformations (50) that strengthen said support spring.

19. A terminal block assembly as defined in claim 16, wherein said support spring leg portions in vertical transverse cross section normally have an outwardly bulging convex configuration whereby when said actuator member is in said engaged position, said support spring leg portions are deformed, toward generally parallel orientations.

20. A terminal block assembly as defined in claim 16, wherein said stationary contact includes lateral recesses (64) that receive said support spring leg portions (54, 56), respectively.

21. A terminal block assembly as defined in claim 16, wherein said support spring normally has in transverse cross-section a generally tear-drop cross-sectional configuration.

22. A terminal block assembly as defined in claim 21, wherein at least one of said support spring leg portions includes an upper section **(56*a*) that is inwardly bent about an intermediate bending line (62)**.

23. A terminal block assembly as de fined in claim 16, wherein said recess comprises an opening contained in one of said support spring leg portions, thereby defining a bridge portion (61) at the upper extremity of said leg portion.

24. A terminal block assembly as defined in claim 23, wherein said support spring contains stiffening deformations (50) that extend upwardly within said leg portions.

* * * * *